US008262864B2

(12) United States Patent
Takamura

(10) Patent No.: US 8,262,864 B2
(45) Date of Patent: Sep. 11, 2012

(54) PAPER MAKING SHOE PRESS BELT

(75) Inventor: Hiroyuki Takamura, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 179 days.

(21) Appl. No.: 12/744,005

(22) PCT Filed: Nov. 19, 2008

(86) PCT No.: PCT/JP2008/071029

§ 371 (c)(1),
(2), (4) Date: May 20, 2010

(87) PCT Pub. No.: WO2009/066700

PCT Pub. Date: May 28, 2009

(65) Prior Publication Data

US 2010/0314065 A1 Dec. 16, 2010

(30) Foreign Application Priority Data

Nov. 20, 2007 (JP) ..... 2007-300409

(51) Int. Cl.
*D21F 3/00* (2006.01)

(52) U.S. Cl. ..... 162/358.2

(58) Field of Classification Search ..... 162/358.2, 162/358.4, 901, 306
See application file for complete search history.

(56) References Cited

U.S. PATENT DOCUMENTS

| | | | |
|---|---|---|---|
| 4,482,430 | A | 11/1984 | Majaniemi |
| 4,559,258 | A | 12/1985 | Kiuchi |
| 6,296,738 | B1 | 10/2001 | Ishii |
| 2005/0126733 | A1 | 6/2005 | Fitzpatrick et al. |
| 2007/0029062 | A1 | 2/2007 | Hikita |
| 2010/0084105 | A1 | 4/2010 | Matuschczyk |
| 2010/0101746 | A1 | 4/2010 | Takano et al. |

FOREIGN PATENT DOCUMENTS

| | | | |
|---|---|---|---|
| CN | 1856618 | A | 11/2006 |
| JP | 59 54598 | | 4/1984 |
| JP | 2001 98484 | | 4/2001 |
| JP | 3104830 | | 10/2004 |
| JP | 2008 223168 | | 9/2006 |
| JP | 2007 119979 | | 5/2007 |
| JP | 2008 231628 | | 10/2008 |
| WO | 2005 049917 | | 6/2005 |
| WO | WO 2008/148584 | A1 | 12/2008 |

OTHER PUBLICATIONS

Chinese Office Action issued Aug. 17, 2011, in Patent Application No. 200880116635 (with English translation).

Extended Search Report issued Dec. 17, 2010 in Europe Application No. 08852071.3.

*Primary Examiner* — Mark Halpern

(74) *Attorney, Agent, or Firm* — Oblon, Spivak, McClelland, Maier & Neustadt, L.L.P.

(57) ABSTRACT

This aims to provide a paper making machine belt (a shoe press belt) having excellent wet squeezability but less damages (such as cracks or wear) of the outer periphery of a belt being used. The paper making shoe press belt includes drainage conduits extended in the felt-side surface thereof. The drainage conduits are discontinuous grooves, and are made semi-arcuate on at least one of the belt ends in a belt running direction (an MD direction).

12 Claims, 9 Drawing Sheets

PAPER MAKING SHOE PRESS BELT

This application is a 371 of PCT/JP08/71029 filed 19 Nov. 2008.

TECHNICAL FIELD

The present invention relates to a shoe press belt (hereinafter also referred to as "belt") used for improving the water squeezing capability from a wet paper web and a felt in the press part of a papermaking machine or a similar machine, and more particularly to the groove configuration provided in the felt-side surface of the shoe press belt.

DESCRIPTION OF THE RELATED ART

In papermaking, the question of how to increase the dewatering amount from the wet paper web in the press part in order to improve productivity is an important issue. The means adopted for increasing the dewatering amount of the press part include: raising the pressure applied by the press roll, increasing the hardness of the press roll, and other methods; among these, the method of improving the dewatering effect by interposing a shoe press belt to extend the time during which pressure is applied between the roll and the felt during pressing has become widespread in recent years.

Recently, the number of shoe press belts has also increased, in which a plurality of grooves is provided in the felt-side surface for efficiently draining the squeezed water. For example, in the shoe press belt in FIG. 1 (according to Patent document 1), the wet paper web dewatering capability is improved by providing a plurality of water drain grooves 9 in an external peripheral surface 8 of a belt 10 used in a wide-width nip press (the so-called shoe press).

Most grooves in the prior art have a rectangular shape for reasons of productivity, cost and because they can be easily manufactured; however, Patent documents 2 and 3 propose grooves with a curved groove bottom part.

FIG. 2 shows a shoe press belt (Patent document 2) wherein a polyurethane resin layer 14 is provided on a base fabric 11, made from a running direction yarn 12 and a width direction yarn 13, and wherein a groove bottom 17 of a water drain groove 16 in the felt side surface has a cross-section in the shape of the letter "U". A belt with good strength durability and dewatering capability (water squeezing capability) of the shoe press can be provided by forming the cross section in the shape of the letter "U", wherein the end parts of the land part of the water drain grooves are chamfered, the groove width is 0.5 to 4 mm, the depth is 0.5 to 5 mm, and the space between adjacent water drain grooves is 1 to 4 mm. In Patent document 3, besides the curved groove bottom, the side walls of the grooves also curve towards the outside.

Furthermore, in FIG. 3 (Patent document 4), a plurality of discontinuous grooves 20 is formed in a resin covering layer 19 of a shoe press belt 18, which is characterized in that said grooves 20 are formed in rectangular shape in the machine direction. This shoe press belt is further characterized in that the length of the machine direction of the grooves 20 is shorter than the length of the machine direction of the long nip press shoe part.

With this type of discontinuous grooves, the highest pressure in the water inside the grooves occurs when the grooves have completely entered the long nip press shoe; therefore, when, thereafter, the grooves leave the press shoe, water is ejected from the grooves and the pressure subsides rapidly. Consequently, it is considered that a shoe press belt having this type of groove configuration improves the water squeezing capability in papermaking machines operating at a relatively low speed of 300 to 800 m/min.

Patent document 1: Japanese Utility Model Application No. S57-147931 (JP, U, 59-54598) microfilm
Patent document 2: JP, Y, 3104830
Patent document 3: JP,A,2001-98484
Patent document 4: WO 2005/049917A

DISCLOSURE OF THE INVENTION

Problems to be Solved by the Invention

Nevertheless, with the shoe press belt according to Patent document 4, cracks tend to occur at the corner parts of the groove end parts when the belt is used because both end parts of the discontinuous grooves in the running direction (machine direction) are in the shape of a rectangle. The object of the present invention, which has been made in view of the above problem, is to provide a shoe press belt for papermaking having good wet paper web dewatering capability and wherein damage (cracks and wear) of the groove end parts does not occur easily.

Means for Solving the Problem

The present inventors have solved the above-mentioned problem and have arrived at the present invention by making the groove configuration of the water drain grooves into discontinuous grooves and by forming at least one end part in the same groove in the shape of a semicircular arc.

The present invention basically relates to a shoe press belt for papermaking wherein, in a discontinuous groove configuration of water drain grooves, the shape of an end part in the running direction (machine direction) is designed; the present invention is based on the following technology.

(1) Shoe press belt for papermaking which is placed between a press roll and a shoe, which carries a felt for receiving water squeezed from a wet paper web, and which is pressed towards the press roll at high pressure; wherein the water drain grooves provided in the felt-side surface are discontinuous grooves, and wherein at least one end part of the discontinuous grooves in the running direction (machine direction) is in the shape of a semicircular arc.

(2) A shoe press belt for papermaking according to (1); wherein, in the same discontinuous groove, the groove depth is substantially uniform.

(3) A shoe press belt for papermaking according to (1) or (2); wherein the groove bottom of the discontinuous groove is in the shape of a semicircular arc.

(4) A shoe press belt for papermaking according to any one of (1) to (3); wherein the groove length of the discontinuous grooves in the running direction (machine direction) is shorter than the press shoe width (the length of the shoe in the machine direction).

(5) A shoe press belt for papermaking according to any one of (1) to (3); wherein the groove length of the discontinuous grooves in the running direction (machine direction) is identical to the press shoe width or greater to twice its size or shorter.

ADVANTAGES OF THE INVENTION

According to the present invention, by configuring the water drain grooves as discontinuous grooves, water can be forcibly expelled due to the pressing effect at the exit of the long nip press shoe; therefore, even when papermaking machines are operated at relatively low speeds, normal dewatering at the press is possible, and the wet paper web dewatering capability improves. Moreover, since at least one machine direction end part in a discontinuous groove is in the shape of a semicircular arc, it is possible to provide a shoe press belt for papermaking wherein damage (cracks and wear) of said discontinuous groove end part does not occur easily.

DESCRIPTION OF THE REFERENCE CHARACTERS

| | |
|---|---|
| 30, 40: | Drill |
| 31, 41: | Drill groove part |
| 32: | Drill head |
| 32A: | Main chip blade |
| 33: | Sub chip blade |
| 42: | Main chip |
| 50, 60, 70, 75, 80, 85: | Belt |
| 51, 61, 71, 76, 81: | Discontinuous groove |
| 52, 62, 63: | End part |
| 53: | Cross machine direction (CMD) land part |
| 54: | Machine direction (MD) land part |
| 82, 87: | Groove bottom |
| S: | Specimen |
| CH: | Cramp hand |
| PR: | Press roll |
| PS: | Press shoe |
| B: | Belt body |
| N: | Nozzle |
| W: | Water flow |
| Ft: | Top-side felt |
| Fb: | Bottom-side felt |
| WS: | Wet paper web sheet |

Best Modes For Carrying Out The Invention

Embodiments of the present invention will be described with reference to the drawings.

Figure 4:
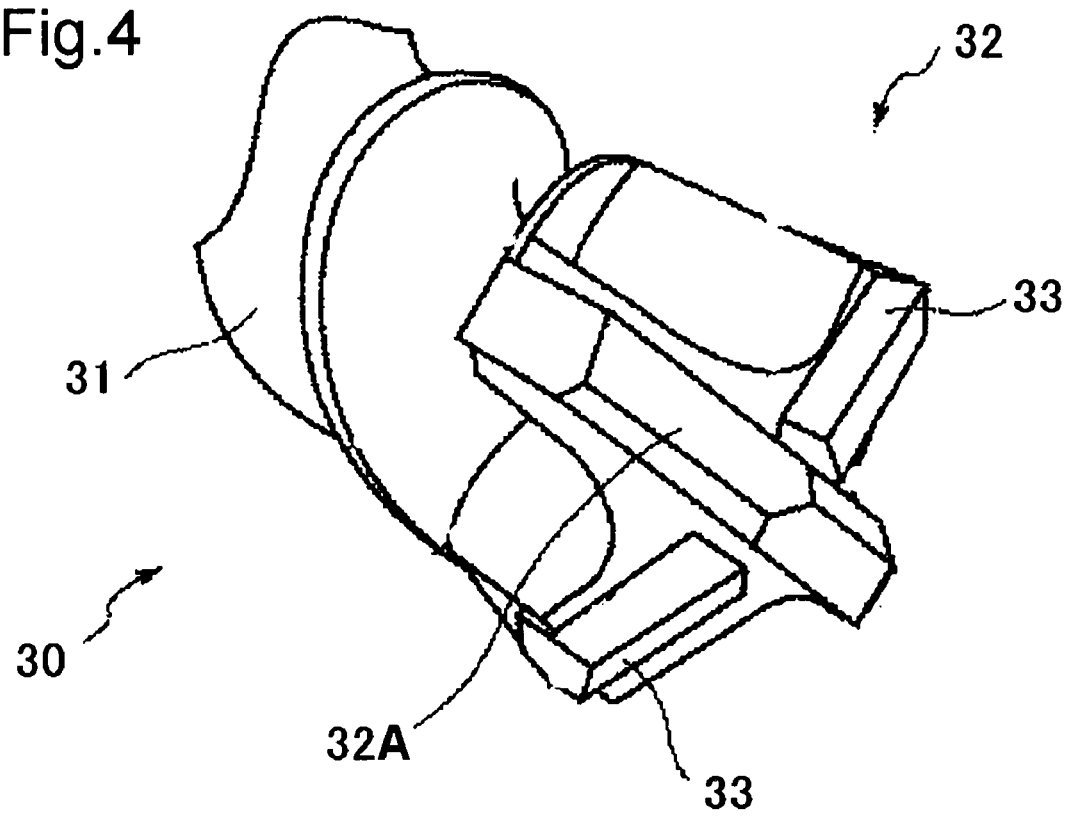
[FIG. 4] A diagram illustrating a drill used for forming grooves according to the present invention.
Figure 5:
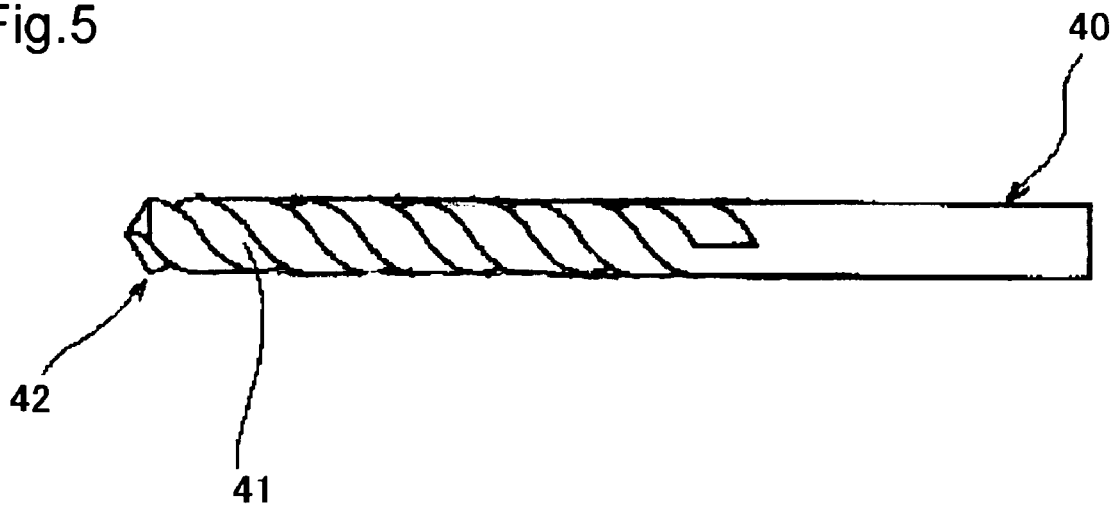
[FIG. 5] A diagram illustrating another drill used for forming grooves according to the present invention.

FIGS. 4 and 5 are schematic diagrams of drills for forming (cutting) water drain grooves of a shoe press belt for papermaking according to the present invention.

In the present invention, a rotating drill is used for forming the water drain grooves in the felt-side surface of a belt; therefore, the machine direction end parts in the discontinuous grooves can be machined in the groove shape of a semicircular arc.

Firstly, a drill 30 in FIG. 4 has chip blades (main chip blade 32A and sub chip blade 33), which forms blade part, at the front end (drill head 32) of a helical groove part 31. The main chip blade 32A is provided so as to intersect the front end of the drill head 32 in a straight line in the diameter direction; and the sub chip blade 33 is divided in two parts by the main chip blade 32A at the front end of the drill head 32. The discontinuous groove configuration according to the present invention can be machined by the drill 30 so that the groove bottom is formed into a flat bottom.

Next, the front end (main chip 42) of a helical groove part 41 of a drill 40 in FIG. 5 is formed into a convex shape; therefore, the discontinuous groove configuration according to the present invention can be machined by the drill in FIG. 5 so that the groove bottom is formed into a semicircular arc.

The method for forming the water drain grooves according to the present invention into discontinuous grooves will be summarized. The required number of drills used in the present invention is mounted in a groove forming device (not shown in the drawings); the front end of the drill is brought into contact with the felt-side surface (external peripheral surface) of a belt into which a groove is to be cut and a groove is cut to the required groove depth. At this time, a circular shape is cut; therefore, one end part of the discontinuous groove to be cut can be formed into a semicircular shape. Next, cutting is performed to the prescribed groove length in the machine direction (MD) by displacing the belt in the machine direction (MD) while the drill is maintained in a fixed position. Then, once the displacement of the belt has been stopped and the front end of the drill is drawn back to a position that is removed from the belt surface, one discontinuous groove is completed. In this case, the other end part of the discontinuous groove is also cut into the shape of a semicircular arc.

Subsequently, after the belt has been displaced by the length of the land part (the portion in which grooves are not cut) in the machine direction (MD), the groove cutting described above is repeated. By thus repeating the same process, the entire peripheral length of the belt is cut. By mounting the required number of drills in a multi-array in the cross-machine direction of the belt, a plurality of discontinuous grooves can be formed in the width direction (cross-machine direction) of the belt by one cutting operation.

Further, discontinuous grooves are grooves which have, in the machine direction (MD), a land part in which grooves are not formed, a groove bottom part in which grooves are formed, a boundary part from the land part to the groove bottom part, and a boundary part from the groove bottom part to the land part.

Figure 6:
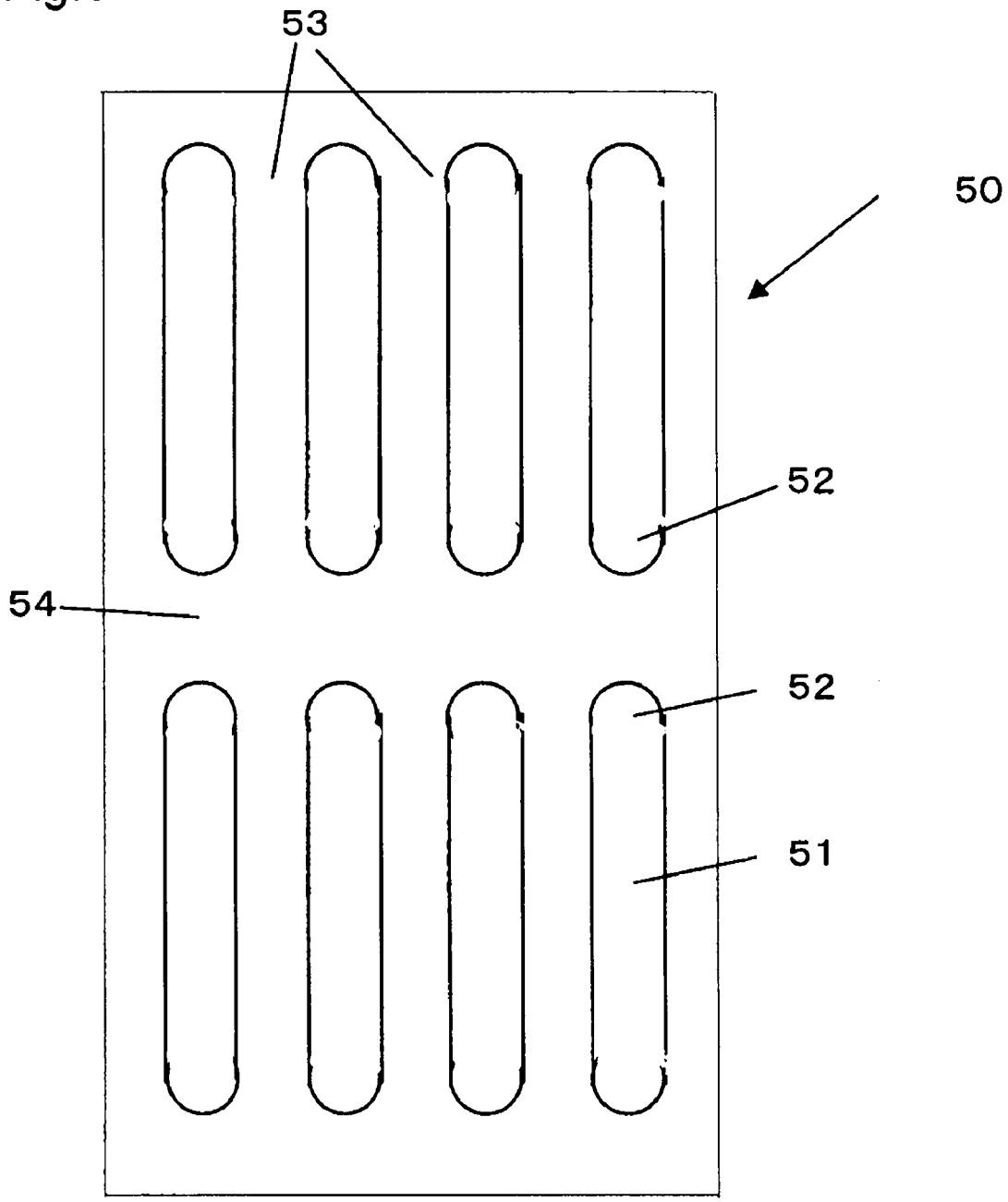
[FIG. 6] A view showing a first embodiment of a groove shape according to the present invention.

A first embodiment of the groove configuration according to the present invention is shown in FIG. 6. FIG. 6 is a plane view of the felt-side surface of a shoe press belt for papermaking according to the present invention. A plurality of discontinuous grooves 51 is formed in the running direction (machine direction) of a belt 50, and end parts 52 of the discontinuous grooves 51 in FIG. 6 are formed in the shape of a semicircular arc. Moreover, the discontinuous grooves 51 are separated by land parts 53, 54 between adjacent grooves. Here, the land parts 53 are the land parts in the cross-machine direction (CMD) of the belt and the land parts 54 are the land parts in the running direction (MD) of the belt.

Figure 7:
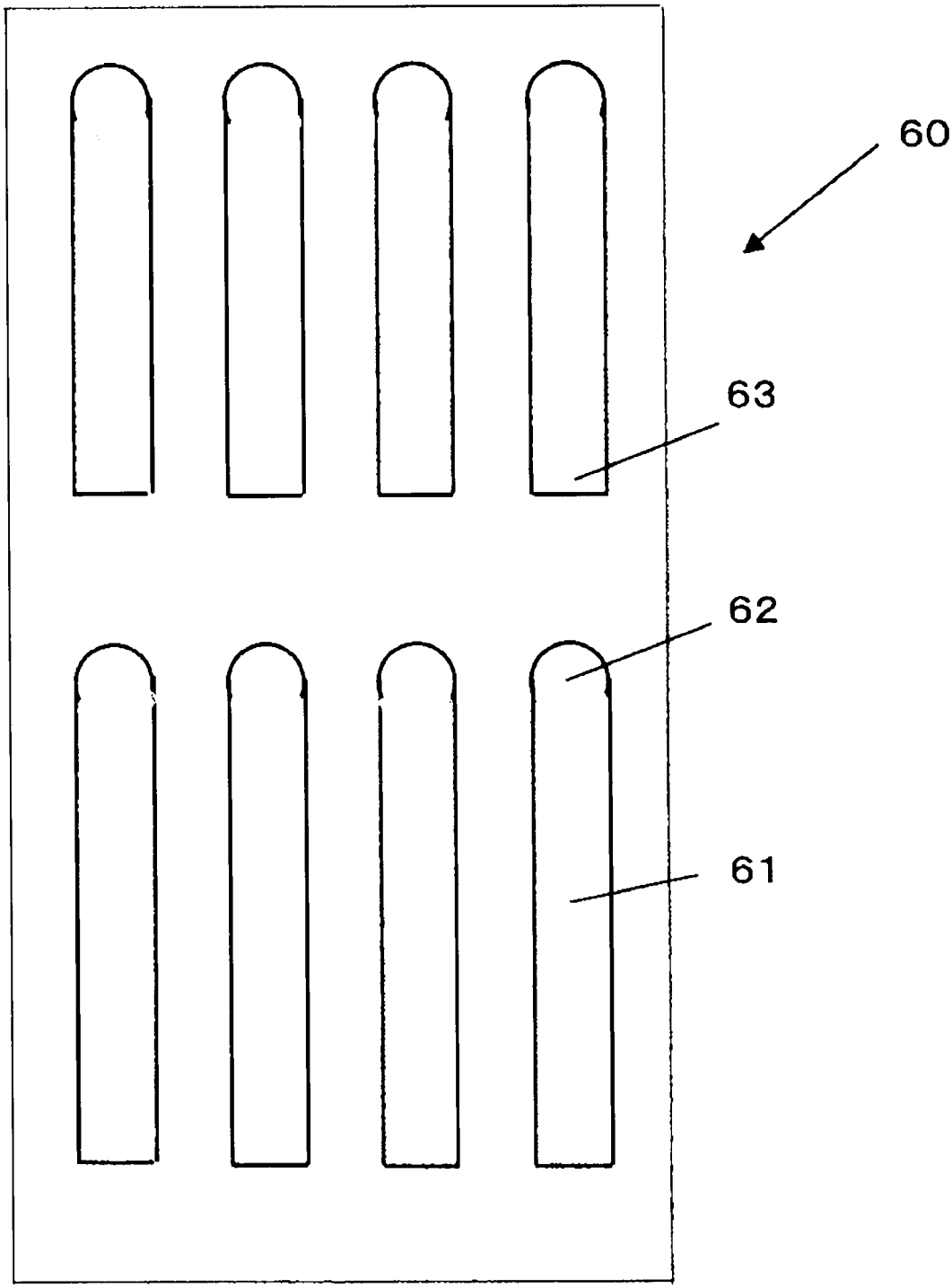
[FIG. 7] A view showing a variation of the first embodiment of a groove shape according to the present invention.

Furthermore, in a belt 60 shown in FIG. 7, one end part 62 (the front end part in the machine direction in FIG. 7) of discontinuous grooves 61 is formed in the shape of a semicircular arc, and another end part 63 (the rear end part in the machine direction in FIG. 7) is formed at right angles.

Conversely, it is also possible to form the front end part in the machine direction (MD) at right angles and the rear end part in the shape of a semicircular arc. These shapes may also be formed at random.

The question of whether to form both end parts in the shape of a semicircular arc or to form only one end part in the shape of a semicircular arc may be suitably decided in view of the wet paper web dewatering capability of the shoe press belt, the cracks and wear occurring and the degree thereof.

Figure 8:
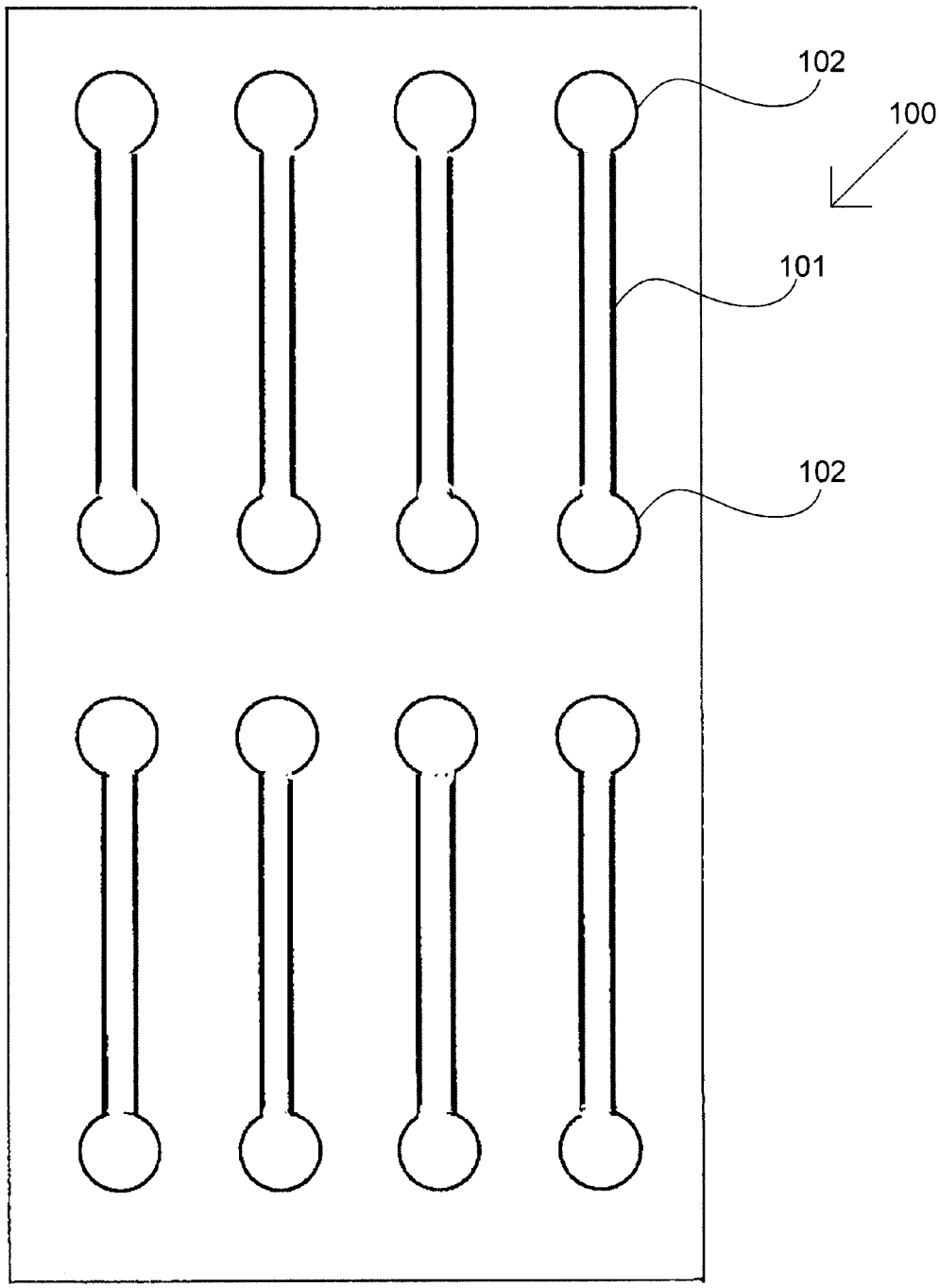
[FIG. 8] A view showing another variation of the first embodiment of a groove shape according to the present invention.

Moreover, in FIGS. 6 and 7, the diameter of the semicircular arc of the machine direction (MD) end parts and the groove width are substantially identical. In the present invention, the diameter of the semicircular arc of the machine direction (MD) end parts 102 may also be wider than the groove width 101, as shown in the belt 100 in FIG. 8; however, in this case, it is necessary to perform the cutting of the machine direction (MD) end parts with a drill of a diameter that is larger than that of the drill used for cutting the machine direction (MD) groove length.

Figure 9:
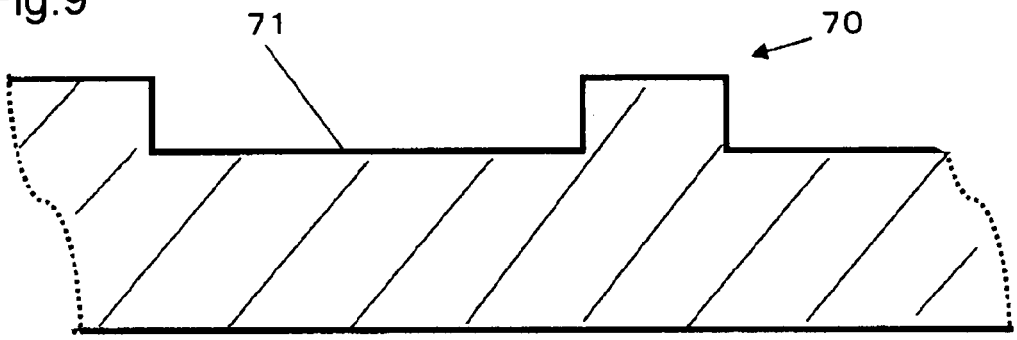
[FIG. 9] A view showing a second embodiment of a groove shape according to the present invention.
Figure 10:
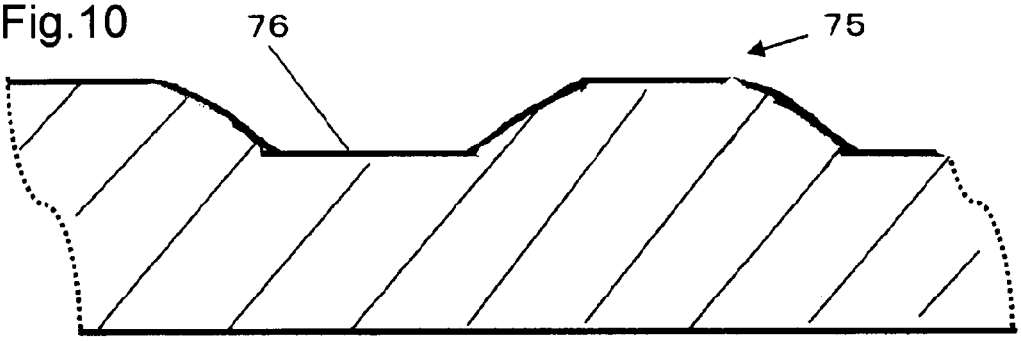
[FIG. 10] A view showing a variation of the second embodiment of a groove shape according to the present invention.

A second embodiment of the groove configuration according to the present invention is shown in FIGS. 9 and 10. FIGS. 9 and 10 are machine direction (MD) cross-sectional views of a shoe press belt for papermaking according to the present invention. In the same groove of discontinuous grooves 71 of belt 70 in FIG. 9, the groove depth is substantially uniform; in other words, the grooves are formed in the machine direction (MD) at a fixed depth. On the other hand, in the present invention, the machine direction (MD) depth of discontinuous grooves 76, as in a belt 75 shown in FIG. 10, may also be designed to become gradually shallower at the end parts and deeper at the central part.

Grooves with a discontinuous groove shape 71 as in FIG. 9 have a large water holding capacity; however, since the highest pressure in the accumulated water volume occurs in the closed grooves inside the press shoe, the accumulated water is easily ejected at the press exit, but cracks and damage may occur at the corner parts of the machine direction (MD) end parts. On the other hand, with a discontinuous groove shape 76 as in belt 75 in FIG. 10, while the groove water holding capacity is less, it is possible to suppress cracks and damage at the machine direction (MD) end parts. Consequently, the question of which shape to adopt may be suitably decided in view of the wet paper web dewatering capability of the belt, the cracks and wear occurring and the degree thereof.

Figure 11:
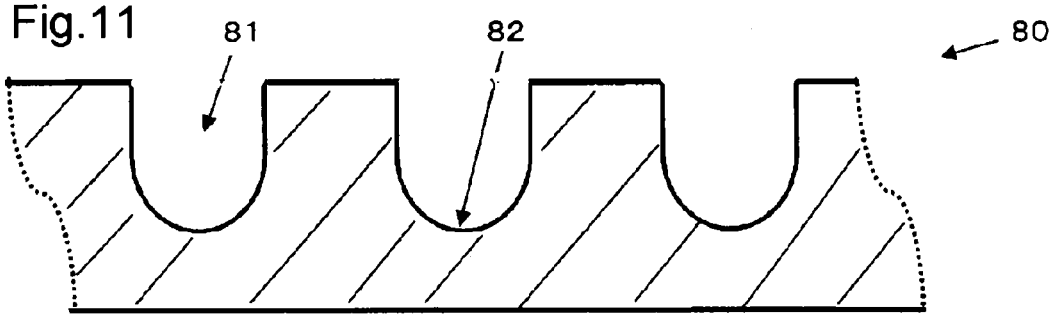
[FIG. 11] A view showing a third embodiment of a groove shape according to the present invention.
Figure 12:
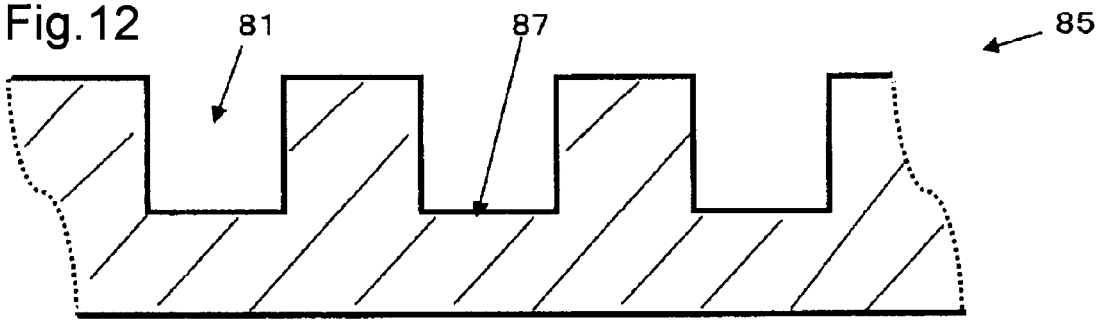
[FIG. 12] A view showing a variation of the third embodiment of a groove shape according to the present invention.

A third embodiment of the groove configuration according to the present invention is shown in FIGS. 11 and 12. FIGS. 11 and 12 are cross-machine direction (CMD) cross-sectional views of a shoe press belt for papermaking according to the present invention. Discontinuous grooves 81 of a belt 80 in FIG. 11 have a groove bottom 82 in the shape of a semicircular arc. On the other hand, according to the present invention it is also possible to form a groove bottom 87 at right angles as in a belt 85 in FIG. 12. With a groove bottom in the shape of a semicircular arc as in FIG. 11, while the groove water holding capacity is less, it is possible to suppress cracks and damage at the at the groove bottom. With a groove bottom shape as in FIG. 12, the groove water holding capacity is large, but cracks and damage may occur at the corner parts of the groove bottom. Consequently, the question of which shape to adopt may be suitably decided in view of the wet paper web dewatering capability of the belt, the cracks and wear occurring and the degree thereof.

Hereinafter, a fourth embodiment of the groove configuration according to the present invention will be described. The fourth embodiment according to the present invention is a discontinuous groove configuration wherein the groove length in the running direction (machine direction) of the discontinuous grooves is shorter than the width of the press shoe.

It is preferred that the machine direction (MD) groove length of the discontinuous grooves according to the present invention is shorter than the width of the press shoe (the machine direction length of the shoe), as mentioned above, because the highest pressure in the water accumulated in the closed grooves occurs when the grooves have completely entered the long nip press shoe. Shoe presses used in the press part of a papermaking machine have press shoes with many different widths; however, generally speaking, widths in the range from 50 to 400 mm are common; therefore, the machine direction (MD) groove length of the discontinuous grooves according to the present invention can be set in the range from 40 to 390 mm which is shorter than the width of the press shoe (the machine direction length of the shoe).

Hereinafter, a fifth embodiment of the groove configuration according to the present invention will be described. In the fifth embodiment according to the present invention, the groove length in the running direction (machine direction) of the discontinuous grooves is identical to the press shoe width or greater to twice its size or shorter.

The groove length which is identical to the press shoe width or greater to twice its size or shorter can be set in the range from 50 to 800 mm.

When a papermaking machine is operated at a medium operating speed of 800 to 1000 m/min, the time it takes for the discontinuous grooves of a belt to pass a long nip press shoe is shorter than the time it takes at a low operating speed. In this case, when discontinuous grooves with a machine direction (MD) length identical to the press shoe width or greater to twice its width or shorter are used, the grooves do not form a groove space that is completely closed in the long nip press shoe; however, due to the dilatancy (Reynolds Phenomenon) occurring as a result of the viscosity effect of the water, a certain degree of high pressure occurs in the accumulated water; therefore, it is possible to maintain the dewatering capability of the wet paper web to a certain degree.

According to the present invention, the groove dimensions are adjusted in the ranges of 0.5 to 2 mm groove width, 0.5 to 2 mm groove depth, and 1 to 5 mm space of the land part between adjacent water drain grooves. Damage to the land parts and broken edges can be avoided by chamfering the corner parts of the land part where no grooves are formed.

According to the present invention, the groove arrays may be arranged uniformly in parallel rows as in FIG. 6, but the arrays may also be formed in a specific pattern as in Patent document 4.

EXAMPLES

Shoe press belts according to the present invention were specifically made for Examples 1 to 9 and Comparative Examples 1 and 2 by the processes described hereinafter.

Process 1: an endless substrate was hanged over 2 rolls and stretched at a prescribed tension.

Process 2: a resin layer (polyurethane layer) was formed on the shoe side of the substrate by applying liquid polyurethane from above the substrate and by curing.

Process 3: after inversing the sides of the substrate, a resin layer (polyurethane layer) was then formed on the felt side of the substrate by applying liquid polyurethane from above the substrate and by curing, whereupon a shoe press belt having a substrate with resin layers on the front and the rear was obtained.

Process 4: a plurality of drills was provided in the groove forming device, the front end of the drill was brought into contact with the felt-side surface of the unmoving shoe press belt, and prescribed discontinuous grooves were formed in the felt-side surface.

Comparative Example 3

Shoe press belts with continuous grooves according to the prior art were specifically made for Comparative Example 3 by the processes described hereinafter.

Process 1 to 3: identical to the processes described above.

Process 4: a plurality of chip saws was provided in the groove forming device, the front end of the chip saw blade was brought into contact with the felt-side surface of the shoe press belt which was displaced in the machine direction (MD), and prescribed continuous grooves were formed in the felt-side surface.

The groove shapes were adjusted in the following ranges.

Figure 14:
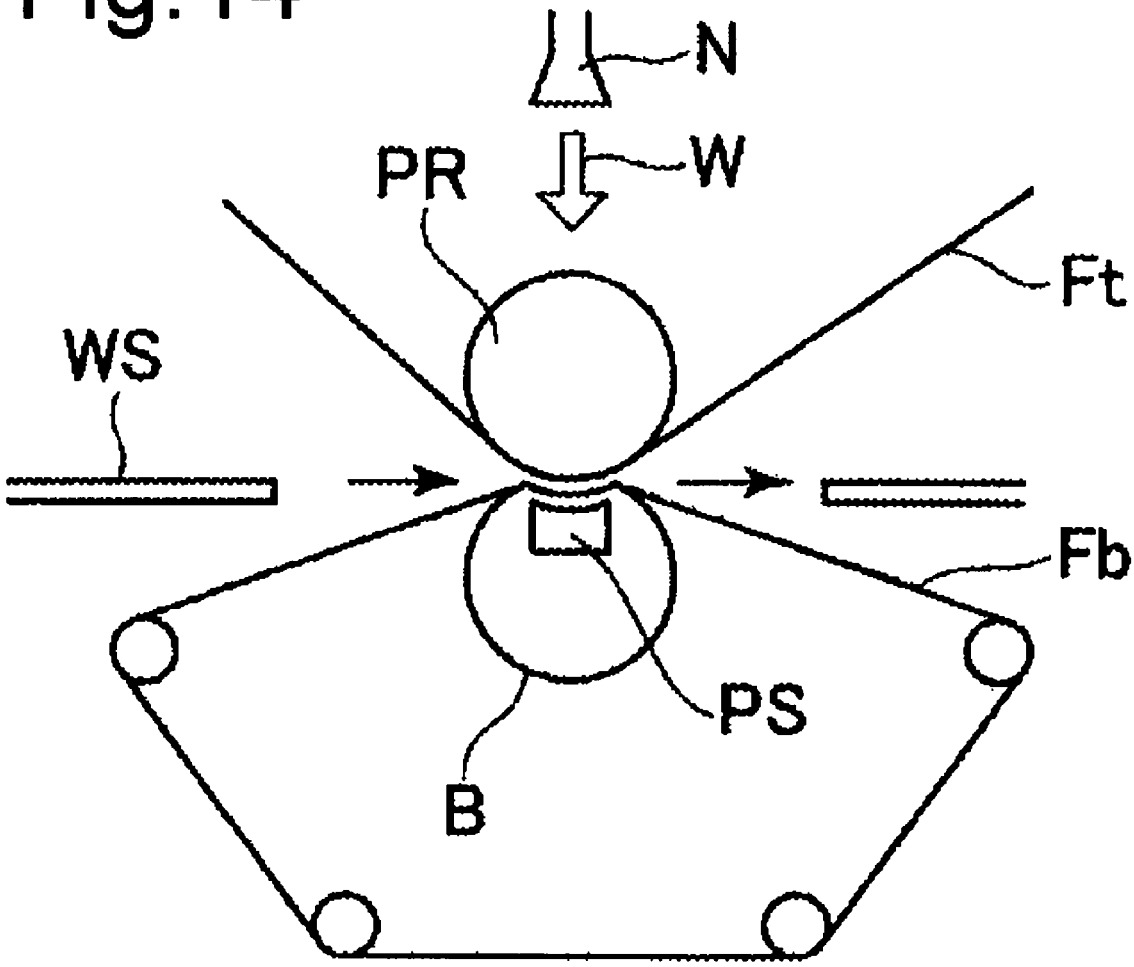
[FIG. 14] A schematic view of the water squeezing test.

(1) Groove width: uniformly 1.2 mm (2) Groove depth: so as to reach 1.5 mm in the deep part of the groove (3) The space of the land part between adjacent water drain grooves in the cross-machine direction (CMD): uniformly 2.0 mm (4) The space of the land part between adjacent water drain grooves in the machine direction (MD): uniformly 5.0 mm (5) Machine direction (MD) length of the discontinuous grooves: the width (shoe length in the machine direction) of a press shoe PS in a test device shown in FIG. 14 was 50 mm; grooves with a shorter length of 40 mm, with an identical length of 50 mm and with a greater length of 90 mm were respectively made.

Shapes of discontinuous grooves formed are shown in Table 1.

TABLE 1

| | Shape of the belt plane view | | | Shape of the | Discontinuous |
|---|---|---|---|---|---|
| | Shape of Front end part | Shape of Rear end part | Shape of the MD belt cross-section | belt groove bottom | groove MD length (mm) |
| Example 1 | semicircular arc | semicircular arc | the groove depth is substantially uniform | rectangular | 40 |
| Example 2 | semicircular arc | semicircular arc | both MD end parts are curved | U-shaped | 40 |
| Example 3 | semicircular arc | semicircular arc | the groove depth is substantially uniform | U-shaped | 40 |
| Example 4 | semicircular arc | rectangular | the groove depth is substantially uniform | U-shaped | 40 |
| Example 5 | semicircular arc | rectangular | the MD rear end part is curved, the front end part is perpendicular | rectangular | 40 |
| Example 6 | semicircular arc | rectangular | the MD front end part is curved, the rear end part is perpendicular | rectangular | 40 |
| Example 7 | rectangular | semicircular arc | the groove depth is substantially uniform | U-shaped | 40 |
| Example 8 | semicircular arc | semicircular arc | the groove depth is substantially uniform | rectangular | 50 |
| Example 9 | semicircular arc | semicircular arc | the groove depth is substantially uniform | rectangular | 90 |
| Comparative Example 1 | rectangular | rectangular | the groove depth is substantially uniform | rectangular | 40 |
| Comparative Example 2 | rectangular | rectangular | the groove depth is substantially uniform | U-shaped | 40 |
| Comparative Example 3 | continuous groove with a rectangular plane view and substantially uniform groove depth | | | rectangular | — |

<Performance Evaluation Method>

Performance was evaluated by conducting the tests described below with the shoe press belts that were manufactured, and an overall evaluation was made by establishing a ranking.

<Crack Test>

Figure 13:
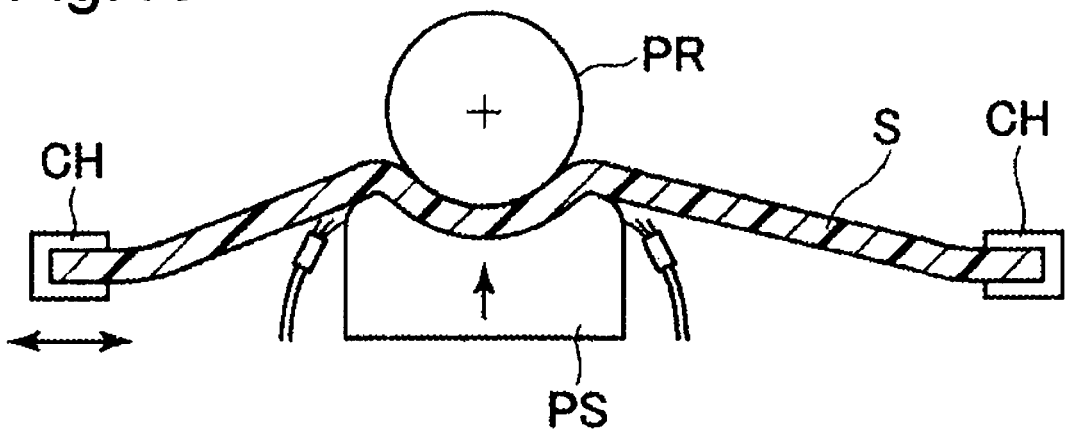
[FIG. 13] A view showing a device used for the crack test.

The device shown in FIG. 13 was used. In this device, both ends of a specimen S are sandwiched by cramp hands CH, CH; the cramp hands CH, CH are configured so that they can move back and forth in the left/right directions in unison. Moreover, the tension applied on the specimen S was 3 kg/cm and the speed of the back and forth movement was 20 cm/sec. The specimen S was pressed by the press roll RR and the press shoe PS. Then, the specimen S was pressed by the displacement of the press shoe PS in the direction of the press roll RR. The pressing force was 50 kg/cm$^2$. With this device, the frequency of the back and forth movements until cracks occur at the machine direction (MD) end parts of the discontinuous grooves or in the vicinity thereof is measured. Moreover, the dimensions of the specimen were 400 mm in the machine direction (MD) (equal to the distance between the cramp hands CH, CH), and 50 mm in the cross-machine direction (CMD). Furthermore, the evaluation surface (felt-side surface) of the specimen S was the side facing the press roll RR. The frequency until cracks occur was:

Evaluation score A: 300,000 times or more,

Evaluation score B: in the range of 200,000 to 300,000 times,

Evaluation score C: in the range of 100,000 to 200,000 times,

Evaluation score D: 100,000 times or less.

<Water Squeezing Test>

The wet paper web water squeezing test was performed by using the device shown in FIG. 14. In the present test device, the belt B was placed in a position facing the press roll PR and the press shoe PS (shoe width: 50 mm) was placed in the internal periphery of said belt so as to press the belt B against the press roll PR. Furthermore, a top-side felt and a bottom-side felt F, both of which were made by flocking a staple fiber of 11 dtex nylon 6 on a base fabric by needle punching so as to obtain a basis weight of 1500 g/m$^2$, were placed between the press roll PR and the belt B. Then the belt B was made to travel at a speed of 800 m/min. under a nip pressure of 1000 kN/m between the press roll PR and the press shoe PS. After which a water flow W was ejected from a nozzle N installed above the press roll PR at a pressure of 3 kg/cm$^2$ and a rate of 15 liters/min. At that time, the top roll was covered by a film from the water flow W, and after penetrating the top-side felt Ft and the bottom-side felt Fb, the water flow W also reached the belt B. Under such conditions, a wet paper sheet WS having 70% moisture content was placed on the bottom felt Fb and passed through the nip; after passing the nip, the moisture content of the wet paper sheet WS was measured. The wet paper web moisture content was:

Evaluation score A: 45% or less,

Evaluation score B: in the range of 45% to 49%,

Evaluation score C: in the range of 49% to 53%,

Evaluation score D: 53% or more.

<Ranking>

Regarding the test results, the overall evaluation was conducted based on the respective evaluation scores of the above tests, and the ranking was attributed as follows:

| | |
|---|---|
| All evaluation scores were A: | Ranking 1 |
| One evaluation score was A and the other was B: | Ranking 2 |
| All evaluation scores were B: | Ranking 3 |
| One evaluation score was C: | Ranking 4 |
| One evaluation score was D: | Ranking 5 |

Figure 1:
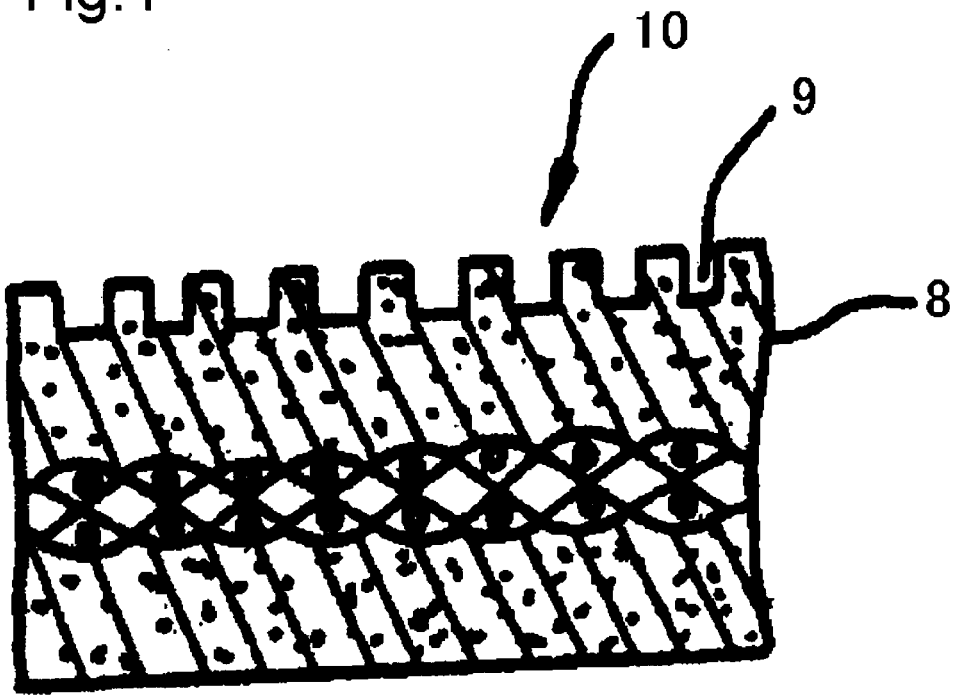
PRIOR ART Fig.1
[FIG. 1] A view showing a conventional shoe press belt.
Figure 2:
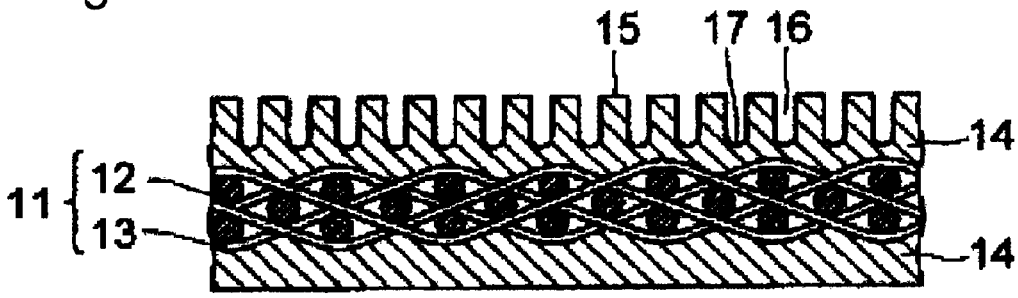
PRIOR ART Fig.2
[FIG. 2] A view showing another conventional shoe press belt.
Figure 3:
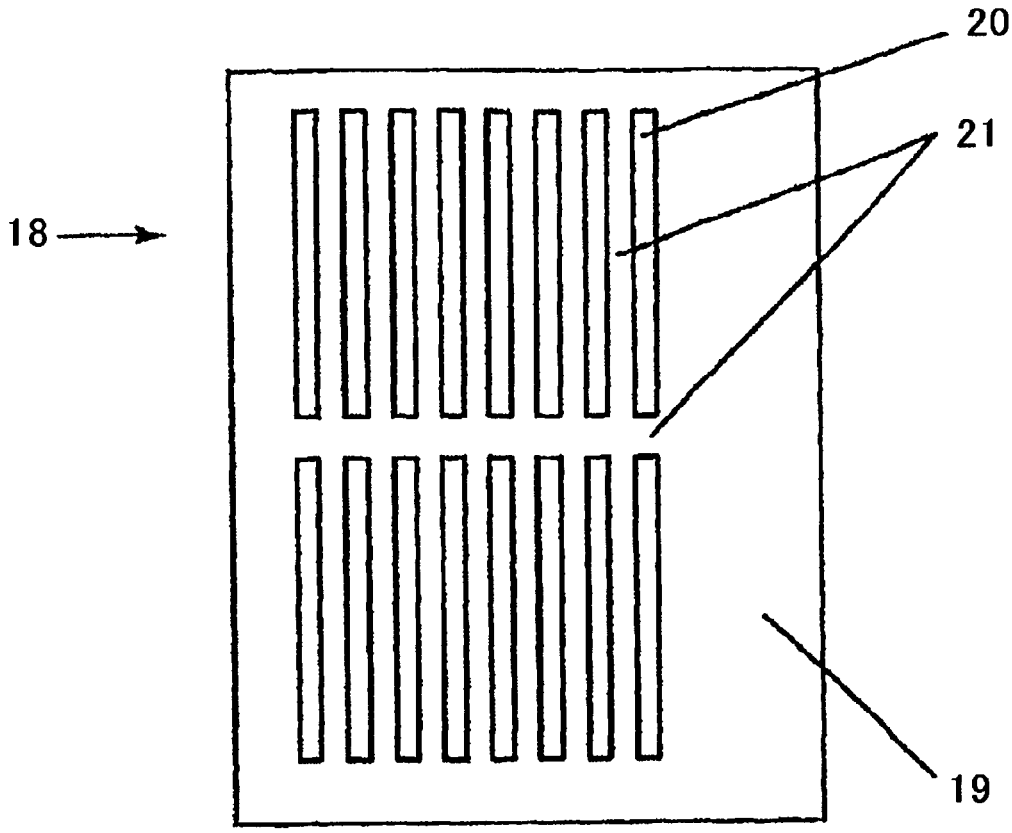
PRIOR ART Fig.3
[FIG. 3] A view showing a conventional shoe press belt wherein discontinuous grooves are formed.

Regarding the shoe press belts relating to Examples 1 to 9 and Comparative Examples 1 to 3, crack tests and water squeezing tests were conducted and the performance was evaluated. The results are shown in FIG. 2.

TABLE 2

| | Crack test | Water squeezing test | Ranking |
|---|---|---|---|
| Example 1 | B | A | 2 |
| Example 2 | A | B | 2 |
| Example 3 | A | A | 1 |
| Example 4 | A | A | 1 |
| Example 5 | A | B | 2 |
| Example 6 | A | B | 2 |
| Example 7 | A | A | 1 |
| Example 8 | B | B | 3 |
| Example 9 | B | C | 4 |
| Comparative Example 1 | D | A | 5 |
| Comparative Example 2 | C | A | 4 |
| Comparative Example 3 | D | D | 5 |

According to the results in Table 2, good evaluation scores were obtained in both evaluation tests with the groove shapes of Example 3 and 7, which were the groove shapes with the best balance of properties.

Moreover, in Example 8, in which the machine direction (MD) length of the discontinuous grooves was identical to the press shoe width, even though the evaluation of the water squeezing test was poorer than in corresponding Example 1, the ranking compared favorably. Furthermore, in Example 9, in which the machine direction (MD) length of the discontinuous grooves is greater than the press shoe width, the evaluation of the water squeezing test was lower than in Example 8; however, the ranking was better than in Comparative Example 3, in which the belt had a continuous groove shape.

Industrial Applicability

According to the present invention, it is possible to make a shoe press belt having good water draining capacity in which the occurrence of cracks during use is reduced, and which is therefore extremely useful as shoe press belt used for improving the dewatering capability from a wet paper web and a felt in the press part of a papermaking machine or a similar machine.

The invention claimed is:

1. A shoe press belt for papermaking, said shoe press belt being placed between a press roll and a shoe and carries a felt that receives water squeezed from a wet paper web, said felt being disposed between the belt and the press roll, and said shoe press belt being pressed towards the press roll at high pressure, said shoe press belt comprising:

water drain grooves disposed in a felt-side surface of said shoe press belt, said grooves being discontinuous grooves, and at least one end part of the discontinuous grooves in a running direction having a semicircular arc shape.

2. A shoe press belt for papermaking according to claim 1, wherein, in a same discontinuous groove, a groove depth is substantially uniform.

3. A shoe press belt for papermaking according to claim 2, wherein a groove bottom of the discontinuous groove has a semicircular arc shape.

4. A shoe press belt for papermaking according to claim 3, wherein a groove length of the discontinuous grooves in the running direction is shorter than a width of the press shoe.

5. A shoe press belt for papermaking according to claim 3, wherein a groove length of the discontinuous grooves in the running direction is equal to or longer than a width of the press shoe and is not longer than twice the width of the press shoe.

6. A shoe press belt for papermaking a according to claim 2, wherein a groove length of the discontinuous grooves in the running direction is shorter than a width of the press shoe.

7. A shoe press belt for papermaking according to claim 2, wherein a groove length of the discontinuous grooves in the running direction is equal to or longer than a width of the press shoe and is not longer than twice the width of the press shoe.

8. A shoe press belt for papermaking according to claim 1, wherein a groove bottom of a discontinuous groove has a semicircular arc shape.

9. A shoe press belt for papermaking according to claim 8, wherein a groove length of the discontinuous grooves in the running direction is shorter than a width of the press shoe.

10. A shoe press belt for papermaking according to claim 8, wherein a groove length of the discontinuous grooves in the running direction is equal to or longer than a width of the press shoe and is not longer than twice the width of the press shoe.

11. A shoe press belt for papermaking according to claim 1, wherein a groove length of the discontinuous grooves in the running direction is shorter than a width of the press shoe.

12. A shoe press belt for papermaking according to claim 1, wherein a groove length of the discontinuous grooves in the running direction is equal to or longer than a width of the press shoe and is not longer than twice the width of the press shoe.

* * * * *